US012173460B2

(12) United States Patent
Neusch

(10) Patent No.: US 12,173,460 B2
(45) Date of Patent: Dec. 24, 2024

(54) SHALLOW MOUNT SAFETY BOLLARDS

(71) Applicant: NEUSCH INNOVATIONS, LP, Marble Falls, TX (US)

(72) Inventor: William H. Neusch, Marble Falls, TX (US)

( * ) Notice: Subject to any disclaimer, the term of this patent is extended or adjusted under 35 U.S.C. 154(b) by 750 days.

(21) Appl. No.: 17/394,974

(22) Filed: Aug. 5, 2021

(65) Prior Publication Data

US 2022/0042263 A1 Feb. 10, 2022

Related U.S. Application Data

(60) Provisional application No. 63/061,494, filed on Aug. 5, 2020.

(51) Int. Cl.
*E01F 15/00* (2006.01)

(52) U.S. Cl.
CPC ..... *E01F 15/003* (2013.01)

(58) Field of Classification Search
CPC ..... E01F 15/003
USPC ..... 404/6, 10
See application file for complete search history.

(56) References Cited

U.S. PATENT DOCUMENTS

| | | | |
|---|---|---|---|
| 1,449,518 | A | 3/1923 | Lawson |
| 1,969,845 | A | 8/1934 | Hick |
| 5,228,237 | A | 7/1993 | Nasatka |
| 5,406,663 | A | 4/1995 | Chen |
| 6,422,783 | B1 | 7/2002 | Jordan |
| 6,702,512 | B1 | 3/2004 | Reale |
| 6,805,515 | B2 | 10/2004 | Reale |
| 7,040,836 | B2 | 5/2006 | Rogers et al. |
| 7,118,304 | B2 | 10/2006 | Turpin et al. |
| 7,607,856 | B2 | 10/2009 | Patel |
| 7,699,558 | B2 | 4/2010 | Adler et al. |
| 7,775,738 | B2 | 8/2010 | Darcy |
| 7,850,391 | B2 | 12/2010 | Omar |
| 8,197,156 | B2 | 6/2012 | Morgan et al. |
| 8,215,865 | B2 | 7/2012 | Adler et al. |
| 8,277,143 | B2 | 10/2012 | Adler et al. |
| 9,127,422 | B2 | 9/2015 | Ball |

(Continued)

FOREIGN PATENT DOCUMENTS

| | | | |
|---|---|---|---|
| AU | 7144900 | A | 5/2001 |
| CA | 2142383 | A1 | 8/1996 |

(Continued)

OTHER PUBLICATIONS

DOS SD-STD-02.01, Revision A Draft, Test Method for Vehicle Crash Testing of Perimeter Barriers and Gates, Jan. 2003.

(Continued)

*Primary Examiner* — Raymond W Addie
(74) *Attorney, Agent, or Firm* — Bradley Arant Boult Cummings LLP; Henry L. Ehrlich

(57) ABSTRACT

A shallow mount safety bollard assembly includes a bottom plate having a front edge, an aft edge, and a longitudinal axis extending in a front-to-aft direction and a lateral axis orthogonal to the longitudinal axis, a pair of side bars, having front ends and aft ends, attached to a top plate surface of the bottom plate, and extending generally parallel to the longitudinal axis, and a bollard connected to the bottom plate between the pair of side bars. The bollard may be permanently or removably connected to the base of the assembly.

19 Claims, 8 Drawing Sheets

(56) References Cited

U.S. PATENT DOCUMENTS

| | | | | |
|---|---|---|---|---|
| 9,133,590 | B2 | 9/2015 | Ball | |
| 10,501,957 | B1 * | 12/2019 | Borowiak | E04H 12/22 |
| 10,753,055 | B2 | 8/2020 | Tosolini et al. | |
| 10,875,368 | B1 | 12/2020 | Angel et al. | |
| 10,988,903 | B1 | 4/2021 | Neusch | |
| 11,174,606 | B1 * | 11/2021 | Lamore | E01F 13/026 |
| 2004/0033106 | A1 | 2/2004 | Turpin et al. | |
| 2006/0090408 | A1 | 5/2006 | Darcy | |
| 2007/0007500 | A1 | 1/2007 | Neusch | |
| 2007/0086858 | A1 | 4/2007 | Morgan et al. | |
| 2008/0181721 | A1 | 7/2008 | Neusch | |
| 2009/0003032 | A1 | 1/2009 | Philipp et al. | |
| 2009/0028638 | A1 | 1/2009 | Crawford et al. | |
| 2009/0035061 | A1 * | 2/2009 | Crawford | E01F 9/681 404/6 |
| 2009/0250674 | A1 | 10/2009 | Darcy | |
| 2011/0033232 | A1 | 2/2011 | Adler et al. | |
| 2011/0062403 | A1 | 3/2011 | Neusch | |
| 2012/0308302 | A1 | 12/2012 | Adler et al. | |
| 2014/0003867 | A1 | 1/2014 | Ball | |
| 2016/0076208 | A1 * | 3/2016 | Gerrard | E04H 12/2238 52/745.1 |
| 2016/0115662 | A1 | 4/2016 | Neusch | |
| 2016/0356006 | A1 | 12/2016 | Neusch | |
| 2018/0016760 | A1 | 1/2018 | Neusch | |
| 2018/0119373 | A1 | 5/2018 | Neusch | |
| 2019/0063020 | A1 | 2/2019 | Neusch | |
| 2019/0154407 | A1 | 5/2019 | Neusch | |
| 2019/0186092 | A1 | 6/2019 | Neusch | |
| 2020/0056339 | A1 | 2/2020 | Ball | |
| 2021/0222382 | A1 | 7/2021 | Neusch | |

FOREIGN PATENT DOCUMENTS

| | | | |
|---|---|---|---|
| DE | 4004851 | A1 | 8/1991 |
| DE | 29717516 | U1 | 1/1998 |
| GB | 2487582 | A | 8/2012 |
| GB | 2490118 | A | 10/2012 |
| GB | 2498161 | B | 5/2017 |
| JP | 10176314 | A | 6/1998 |
| JP | 11061746 | A | 5/1999 |
| JP | 2001295298 | A | 10/2001 |
| JP | 2002115324 | A | 4/2002 |

OTHER PUBLICATIONS

ASTM F2656-07 Standard Test Method for Vehicle Crash Testing of Perimeter Barriers, Aug. 2007.

ASTM F3016/F3016M-19 Standard Test Method for Surrogate Testing of Vehicle Impact Protective Devices at Low Speeds, Sep. 2019.

Ameristar/ATG Access Shallow Mount Defender Anti-Ram Bollards Brochure, May 2014.

Ameristar/ATG Access Shallow Mount SP 1000 Defender Anti-Ram Bollards Brochure, May 2014.

ATG Access Westminster Bridge Protection Bollard Brochure.

Ameristar Shallow Mount Bollard Installation Document.

Ameristar K4 Shallow Mount Bollard Drawing, Mar. 29, 2013.

Elkosta Perimeter Protection M50 Fixed Shallow Mounted Bollard, Technical Data Sheet, Mar. 3, 2013.

* cited by examiner

SHALLOW MOUNT SAFETY BOLLARDS

BACKGROUND

This section provides background information to facilitate a better understanding of the various aspects of the disclosure. It should be understood that the statements in this section of this document are to be read in this light, and not as admissions of prior art.

Vehicle barrier systems are used to protect premises and people from the unauthorized entry of vehicles. Anti-ram vehicle barriers (AVB) systems or vehicle security barriers (VSB) are configured to stop motor vehicles, such as trucks, that crash into the barrier. Some AVBs are designed to stop vehicles that are intentionally crashed into the barrier in an attempt to enter the protected area for nefarious purposes.

Some anti-ram vehicle barriers are crash tested to ensure compliance with and obtain certification from a recognized standard. For example, the American Standard Test Method (ASTM F2656 and F3016), British Standard Institute (PAS 68) and the International Organization for Standardization (ISO) and International Works Agreement (IWA 14-1).

The U.S. State Department (DOS) published the certification standard SD-STD-02.01 (Test Method for Vehicle Crash Testing of Perimeter Barriers and Gates) in 1985. The test vehicle was specified as a medium-duty truck weighing 15,000 lb. (6800 kg) and the nominal velocities were 30 mph (50 km/h), 40 mph (65 km/h) and 50 mph (80 km/h). Penetration was measured from the pre-impact attack (front) side of the vehicle security barrier (VSB) and classified into three categories of penetration rating. In 2003, the standard was revised with measuring the penetration from the asset or protected (rear) side of the barrier and the limitation of permissible vehicle penetration to one meter (the highest level of penetration rating).

In 2007, the SD-STD-02.01 was replaced with ASTM F2656-07. This new standard included the medium-duty truck and added three new test vehicle types, a small passenger car, pickup truck, and a heavy goods truck. ASTM F2656-07 maintained three predetermined impact velocities for each vehicle category and penetration is measured from the rear face of the barrier and classified into four categories of penetration rating. The penetration ratings include P1 for less than or equal to 1 m (3.3 ft); P2 for 1.10 to 7 m (3.31 to 23.0 ft); P3 for 7.01 to 30 m (23.1 to 98.4 ft); and P4 for 30 m (98 ft) or greater. ASTM F2656 was revised in 2015 (ASTM F2656-15) to include two additional vehicle types, a full-sized sedan and a cab over/cab forward class 7 truck and it excluded the lowest penetration rating (P4). Vehicle categories include M-ratings: medium duty truck (15,000 lb.); C-rating: small passenger car (2,430 lb.); PU-rating: pickup truck (5,070 lb.); and H-ratings: heavy goods vehicle (65,000 lb.). As an example, an M-rating is an equivalent vehicle as a K-rating. An M50-P1 certified barrier has been tested by impacting a 15,000-lb. vehicle travelling perpendicular to the barrier at 50 mph and stopping the vehicle within 1 meter of the barrier.

ASTM F3016 establishes standards for anti-ram at low speeds. Whereas ASTM F2656 addresses greater speeds and different weight vehicles such as may be used in an intentional act, such as a terrorist attack, ASTM F3016 addresses standards for vehicle safety barriers to protect pedestrians and storefront property. Storefronts, bus stops, restaurant patios, sidewalks, propane tanks, and gasoline pumps are examples of protected areas particularly suited for F3016 type vehicle safety barriers. ASTM F3016 provides for a range of low impact speeds, 20 to 60 km/h (10 to 30 mph), with a 22,250 N (5,000 lb) test vehicle. Penetration ratings are based on displacement of the barrier into the protected area or maximum intrusion of the vehicle impactor nose into the protected area. The speed ratings are S10 (20 km/h; 10 mph); S20 (35 km/h; 20 mph); and S30 (50 km/h; 30 mph) and penetration ratings are P1 (less than or equal to 0.30 m; 1 ft) and P2 (0.31-1.22 m; 1 ft). Penetration of greater than P2 is a failure.

In 2005, the British Standard Institute (BSI) published PAS 68:2005 Specification for Vehicle Barriers: Fixed Bollards. The standard was expanded within two years to include other types of barriers, such as gates and road blockers. The 2013 version, "Impact Test Specifications for Vehicle Security Barrier Systems," rates vehicle barrier systems based on six types of test vehicles, including seven test speeds, and penetration is measured from the rear (protected side) face of the barrier. PAS 68 defines the vehicle type, penetration, dispersion of debris and records the angle of the vehicle's approach. The PAS 68 rating includes a five-to-seven-part classification code, the includes: Classification of Test/Gross Weight of Vehicle (kg) (Vehicle Class)/Impact Speed/Angle of Impact: Distance Leading Edge of Load Bay travels beyond the Original Position of Rear Face/Dispersion Distance of major debris weighing 25 kg or more from the barrier to establish stand-off distance. For example, a barrier (bollard) tested by impact by a 7500 kg day cab ("V") at a ninety-degree angle traveling 80 km/h and resulting in penetration of 7.5 m with significant debris scattered up to 20.0 m away would be designated as V/7500(N3)/80/90:7.5/20.0. The dispersion distance may be used to determine a stand-off distance for example to mitigate damage from a vehicle born improvised explosive device (VBIED).

The European Committee for Standardization (CEN) recognized across 34 European countries has produced a standard CWA 16221 that combines details of PAS 68 and PAS 69. PAS 69 provides guidance on the barrier's use and installation.

In 2013, the International Works Agreement (IWA) 14-1: 2013 was published to provide an international specification for crash-testing. The system was developed by government agencies, military bodies and providing companies from the USA, UK, Germany, Norway, Oman, Singapore, and Syria. This standard includes a merging of vehicle impact test specifications of the British PAS 68 and the American ASTM F2656. This international standard assesses vehicle barrier performance based on nine types of test vehicles with up to seven test speeds. Penetration is measured from the front (attack side) face of the AVB. The IWA 14 classification code represents Vehicle Impact Test/Gross Weight of Vehicle (Vehicle Class)/Impact Speed/Angle of Impact/Penetration beyond the original position of the Front/Impact face.

Vehicle safety barriers may be designated or marketed as crash-rated, certified, or engineer-rated. Certified or crash-rated systems have been crash-tested and certified by an independent testing facility pursuant to a referenced testing standard, e.g., ASTM, PAS, IWA. Engineered or engineer-rated systems have been designed and computer-analyzed to meet a designation within a referenced standard but not crashed tested or certified.

SUMMARY

An exemplary bollard assembly includes a bottom plate having a front edge, an aft edge, and a longitudinal axis extending in a front-to-aft direction and a lateral axis orthogonal to the longitudinal axis, a pair of side bars, having front ends and aft ends, attached to a top plate surface of the bottom plate, and extending generally parallel to the longitudinal axis, and a bollard connected to the bottom plate between the pair of side bars.

Another exemplary bollard assembly includes a bottom plate having a front edge, an aft edge, and a longitudinal axis extending in a front-to-aft direction and a lateral axis perpendicular to the longitudinal axis, a pair of side bars, having front ends and aft ends, attached to a top plate surface of the bottom plate and extending generally parallel to the longitudinal axis, a sleeve having a bottom end attached to the top plate surface between the pair of side bars, an internal bore, and a top opening, a bollard having a lower section located in the internal bore, and a latch moveable from a lock position fixedly securing the bollard to the sleeve and an unlock position allowing the bollard to be removed from the sleeve.

Another exemplary bollard assembly includes a bottom plate having a front edge, an aft edge, and a longitudinal axis extending in a front-to-aft direction and a lateral axis perpendicular to the longitudinal axis, a pair of side bars, having front ends and aft ends, attached to a top plate surface of the bottom plate and extending generally parallel to the longitudinal axis, a front bar attached directly to the top plate surface proximate the front ends and extending to the pair of side bars, a sleeve having a bottom end attached to the top plate surface between the pair of side bars, an internal bore, and a top opening, a member directly connected to the sleeve and the front bar, a bollard having a lower section located in the internal bore, and a latch moveable from a lock position fixedly securing the bollard to the sleeve and an unlock position allowing the bollard to be removed from the sleeve.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Figure 1:
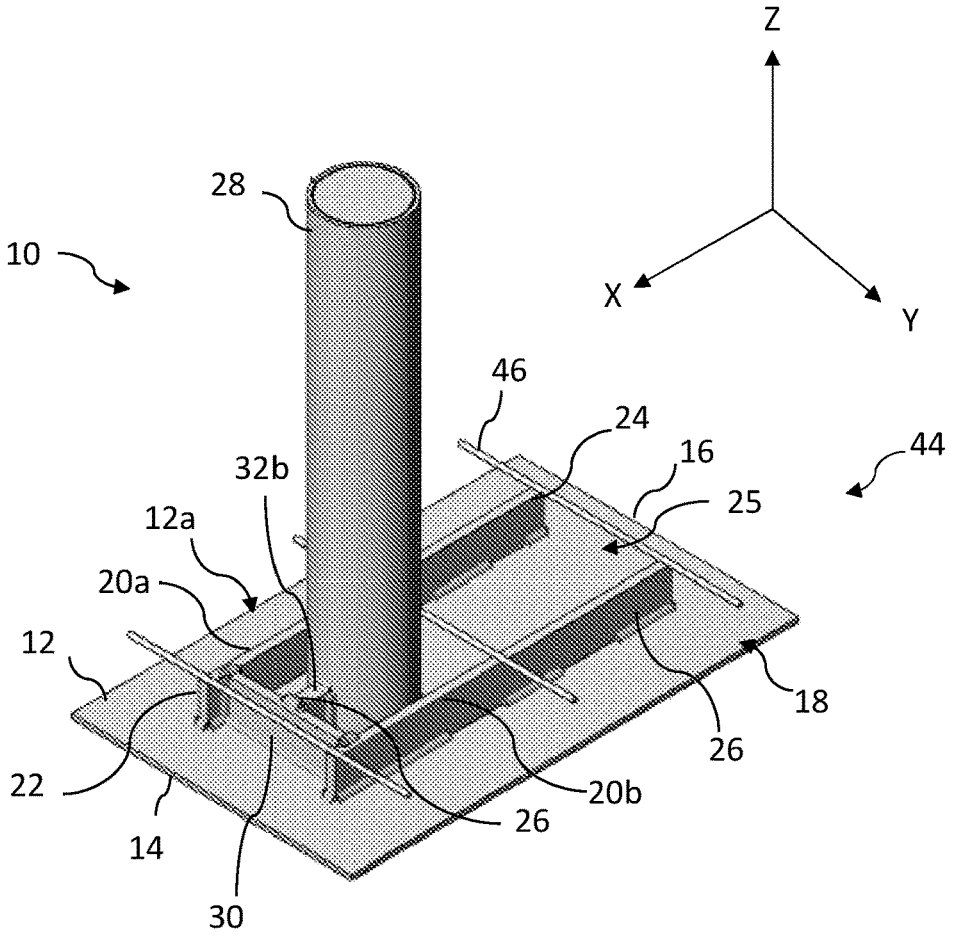
FIG. 1 is a perspective view of an exemplary shallow mount safety bollard assembly with a fixed bollard.
Figure 2:
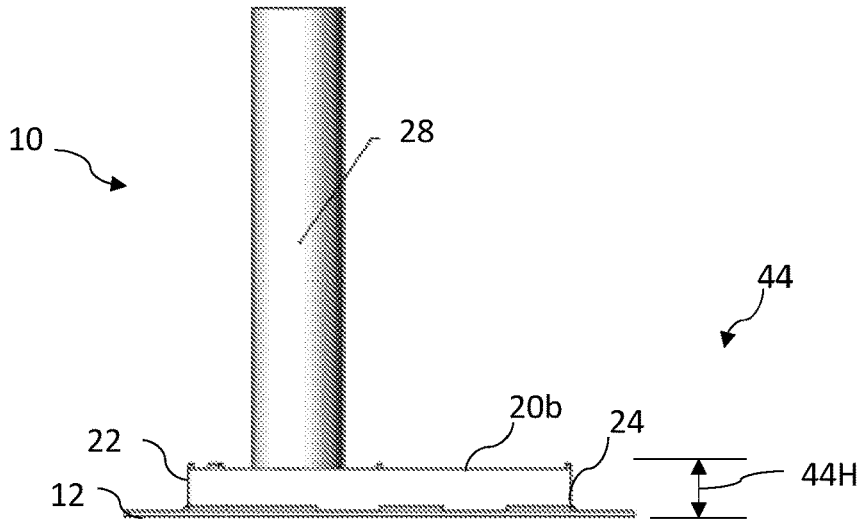
FIG. 2 is a right-side view of the exemplary bollard assembly of FIG. 1.

It is to be understood that the following disclosure provides many different embodiments, or examples, for implementing different features of various illustrative embodiments. Specific examples of components and arrangements are described below to simplify the disclosure. These are, of course, merely examples and are not intended to be limiting. For example, a figure may illustrate an exemplary embodiment with multiple features or combinations of features that are not required in one or more other embodiments and thus a figure may disclose one or more embodiments that have fewer features or a different combination of features than the illustrated embodiment. Embodiments may include some but not all the features illustrated in a figure and some embodiments may combine features illustrated in one figure with features illustrated in another figure. Therefore, combinations of features disclosed in the following detailed description may not be necessary to practice the teachings in the broadest sense and are instead merely to describe particularly representative examples. In addition, the disclosure may repeat reference numerals and/or letters in the various examples. This repetition is for the purpose of simplicity and clarity and does not itself dictate a relationship between the various embodiments and/or configurations discussed.

FIGS. 1-7 illustrate exemplary aspects of shallow mount safety bollard assemblies 10. Shallow mount safety bollard assemblies 10 are configured to be engineer-rated or crash-rated pursuant to a referenced testing standard, e.g., DOD, DOS, ASTM, PAS, BSI, IWA, and ISO. Some embodiments of bollard assembly 10 may be engineer-rated but not crash tested. Some embodiments of bollard assembly 10 may not be engineer-rated or crash-rated.

An exemplary embodiment of the shallow mount safety bollard assembly 10 is crash-certified by a third-party independent test laboratory to ASTM F-3016-19 S30 P1 requirements. Engineer-rated ASTM F-3016 S10 and S20 test level shallow mount safety bollard assemblies are also disclosed. Single bollard units have been tested and certified to provide for customizable spacing.

FIGS. 1-6 illustrate exemplary aspects of a shallow mount fixed safety bollard assembly 10, where the bollard is "permanently" fixed to the base. FIGS. 7-17 illustrate exemplary aspects of a shallow mount removable safety bollard assembly 10, where the bollard is removably attached to the base. Shallow mount generally describes a foundation of about 18 inches or less. Embodiments disclosed herein only require about 8 inches of foundation or excavation for installation in a pre-existing sidewalk or concrete slab. The assembly does not require rebar for installation making the bollard assembly a quick and simple solution for existing buildings and sidewalks with underground utilities. The front of the bollard assembly is intended to face the direction of anticipated vehicle impacts.

Figure 7:
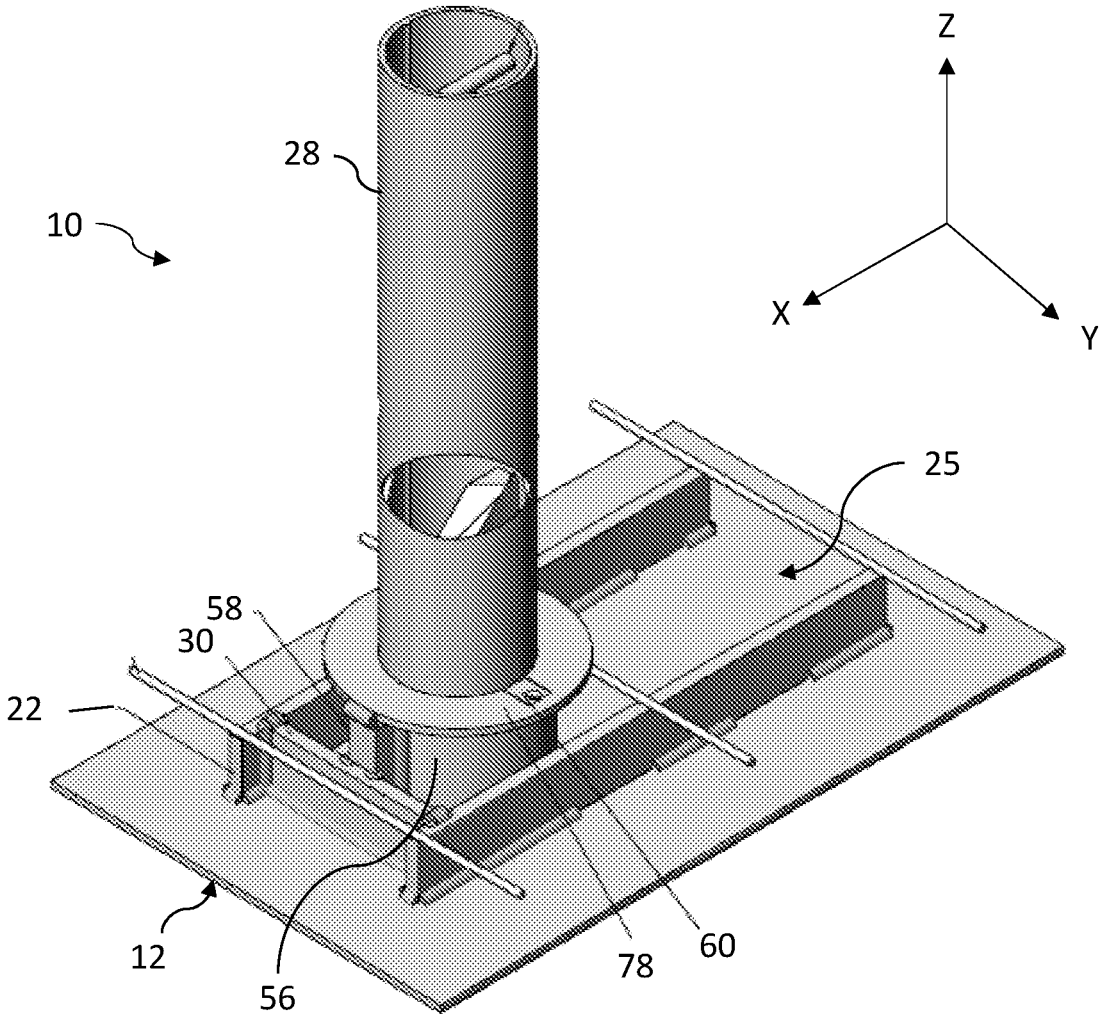
FIG. 7 is a perspective view of an exemplary shallow mount safety bollard assembly with a removable bollard.

FIGS. 1 and 7 depict three mutually orthogonal directions along a longitudinal axis "X," a lateral axis "Y," and a vertical axis "Z." With reference in particular to FIGS. 1 and 7 exemplary bollard assemblies 10 includes a bottom plate 12 having a front edge 14, an aft edge 16, and a longitudinal axis X extending in a front-to-aft direction and a lateral axis Y. The illustrated bottom plate has a rectangular perimeter 18, however, the bottom plate may have a non-rectangular shape. A pair of side bars 20*a*, 20*b*, having front ends 22 and aft ends 24, are attached directly to a top plate surface 12*a* of bottom plate 12, for example by welds 26, and extend generally parallel to the longitudinal axis. A bollard 28 is connected to bottom plate 12 between the pair of side bars 20*a*, 20*b*. Bollard 28 is fixed directly to bottom plate 12 for example by a weld in FIG. 1 and bollard 28 is removably connected to bottom plate 12 in FIG. 7.

Bollard 28 is connected to bottom plate 12 proximate front ends 22 of side bars 20*a*, 20*b*. Front ends 22 and aft ends 24 may be located inward of front edge 14 and aft edge 16. In the illustrated embodiments, a front bar 30 is attached directly to top plate surface 12*a* and extend to side bars 20*a*, 20*b*. Bollard assembly 10 may include one or more rebar sections 46 attached to side bars 20*a*, 20*b*. The one or more rebar sections 46 do not extend beyond the perimeter of the bottom plate. The one or more rebar sections provide reinforcement to the concrete that is poured on top of the bottom plate and do not provide support to the bollard assembly. With reference to FIGS. 1 and 7, the area 25 between side bars 20*a*, 20*b*, front bar 30 and bottom plate 12 is not enclosed by a metal member.

Bollard assembly 10 is constructed for example of steel members. In a non-limiting example, bottom plate is a 0.5-inch steel plate with a length, in the longitudinal direction, of approximately 48 inches and a width, in the lateral direction, of about 30 inches. Bollard 28 is an 8-inch pipe, for example schedule 40 pipe, having a length of approximately 46 to 48 inches. Side bars 20*a*, 20*b* and front bar 30 are planar steel members. In the illustrated examples, side bars 20*a*, 20*b* and front bar 30 have a vertical height of approximately 4 inches and a width of approximately 1 inch. The base 44 includes bottom plate 12, side bars 20*a*, 20*b*, and front bar 30. In this embodiment, base 44 has a base height 44H (FIG. 2) of approximately 4.5 inches. When base 44 is placed in an excavation and covered with concrete, the base height, or foundation height, is approximately 8 inches.

Figure 3:
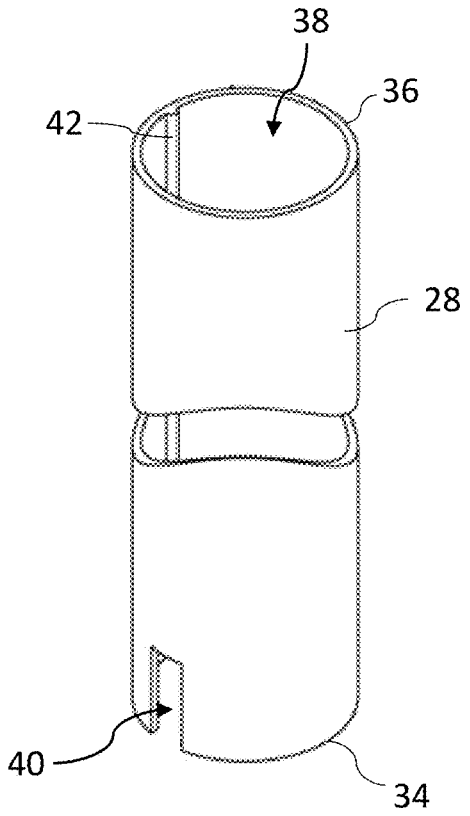
FIG. 3 is a perspective view of an exemplary bollard.
Figure 4:
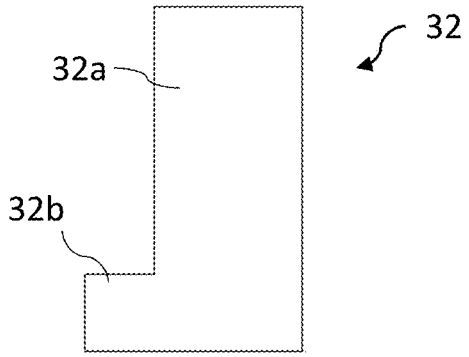
FIG. 4 is a side view of an exemplary bollard stiffener in isolation.

Referring in particular to FIGS. 1-6, bollard 28 is connected directly to bottom plate 12 for example by welding. Bollard 28 may include a plate 32 (FIG. 4), for example stiffener, positioned inside of bollard 28. FIG. 3 illustrates an exemplary bollard 28 having a bottom end 34, a top end 36, and an internal bore 38. A vertical slot 40 extends from bottom end 34. FIG. 4 illustrates an exemplary plate 32. Plate 32 is a generally L-shaped member having a stiffener section 32*a* and an extension section 32*b*. Stiffener section 32*a* is positioned inside of bollard 28 and has a greater vertical height than extension section 32*b*. Extension section 32*b* extends out of bollard 28 through slot 40. As shown in FIG. 1, extension 32*b* may be fixedly connected directly to front bar 30 for example by a weld. Slot 40 may be positioned 90-degrees from the pipe seam 42. In a non-limiting example, plate 32 is a steel plate having a width of approximately 1 to 1.5 inches.

Figure 5:
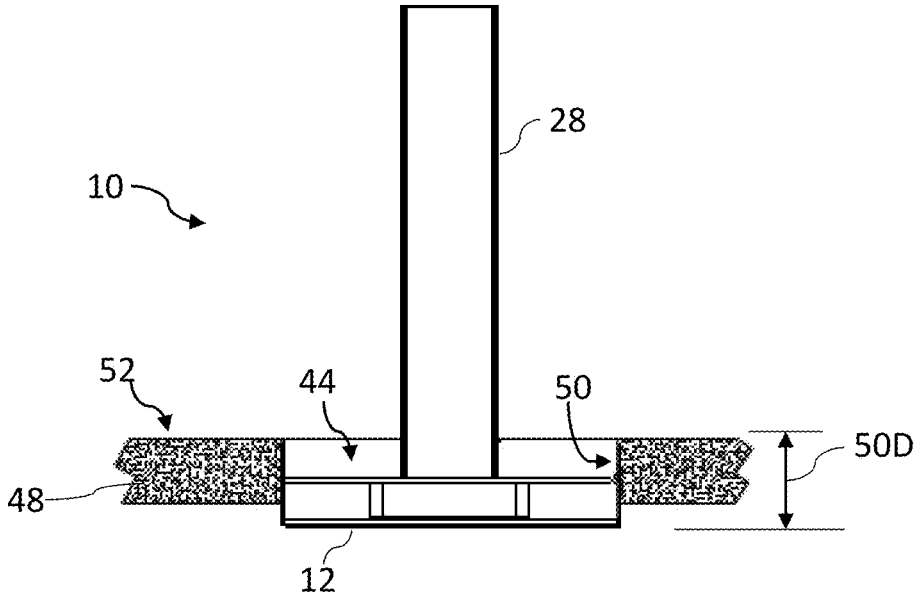
FIG. 5 is a front view of an exemplary shallow mount safety bollard assembly with a fixed bollard placed in an excavation.
Figure 6:
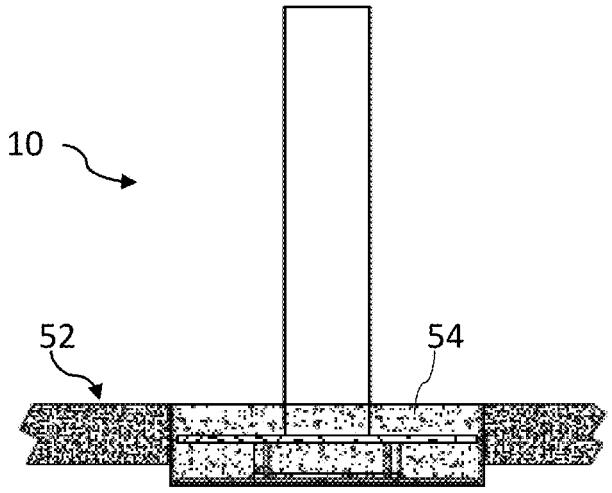
FIG. 6 is a front view of the base of the exemplary shallow mount safety bollard assembly of FIG. 5 set in concrete.

FIGS. 5-6 illustrate installation of a bollard assembly 10 in a pre-existing concrete slab 48 such as a sidewalk. An excavation 50 having a depth 50D from grade 52 is made in the concrete slab 48. In this example, depth 50D is approximately 8 inches for a bollard assembly having a base height of approximately 4.5 inches. Base 44 is placed in the excavation and concrete 54 is poured on top of base 44 to fill excavation 50 to grade 52.

Figure 8:
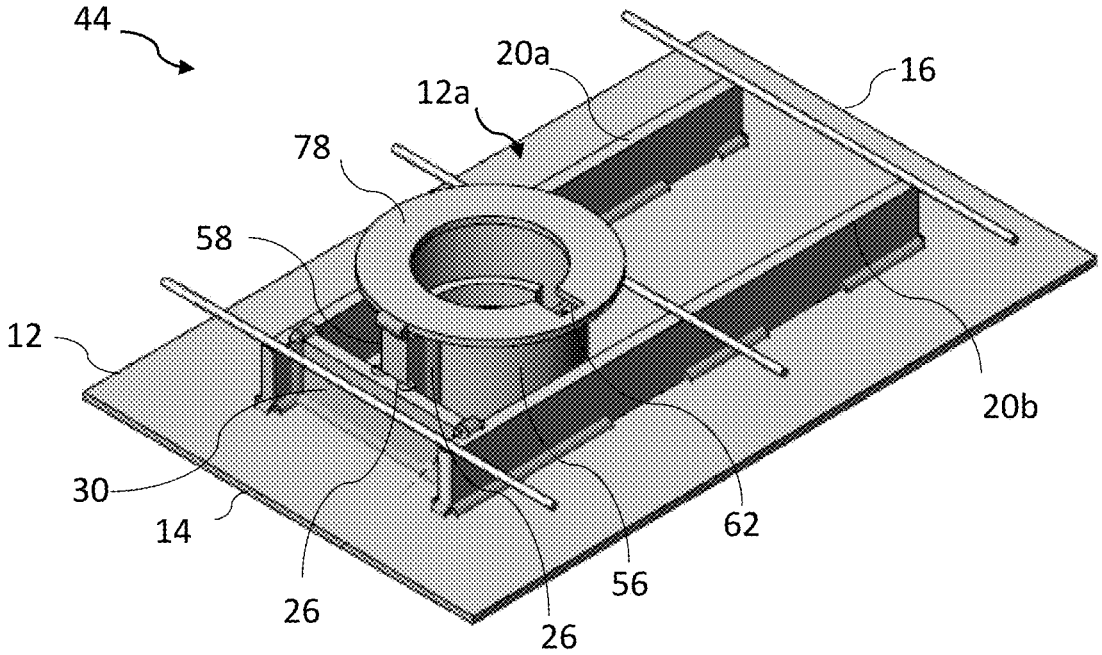
FIG. 8 is a perspective view of the safety bollard assembly of FIG. 7 with the bollard removed from the base.
Figure 9:
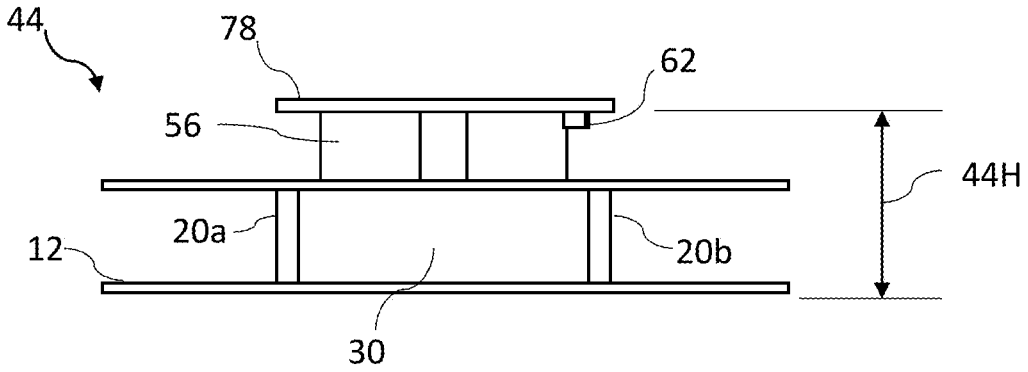
FIG. 9 is front view of the base of the safety bollard assembly of FIG. 8.
Figure 10:
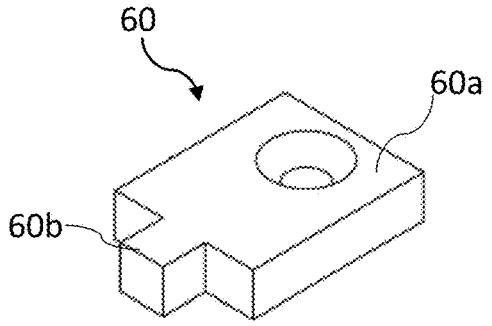
FIG. 10 is a perspective view of an exemplary latch in isolation.

Referring to FIGS. 7-17, bollard 28 is removably connectable to base 44 and bottom plate 12. In this embodiment, bollard 28 is removably connectable to base 44 via a sleeve 56. Sleeve 56 is directly attached to bottom plate 12, for example by a weld. In an exemplary embodiment sleeve 56 is also attached to a front bar 30. For example, a steel bar 58 is welded to sleeve 56 and front bar 30. FIG. 7 illustrates bollard 28 in a locked position fixedly securing bollard 28 to sleeve 56 and therefore to bottom plate 12. A latch 60 is moveable from the lock position (FIG. 7) fixedly securing the bollard to the sleeve and an unlocked position (FIG. 8) allowing the bollard to be removed from the sleeve. In the locked position, latch 60 engages bollard 28 and sleeve 56. For example, a first latch portion may be positioned in a receiver on the sleeve and a second latch portion disposed in a hole in the bollard. FIG. 10 illustrates an exemplary latch 60 having a first portion 60*a* configured to fit in a receiver 62 (FIGS. 8, 9) on sleeve 56 and a second portion 60*b* configured to fit in a hole 64 (FIG. 11) in bollard 28.

Figure 11:
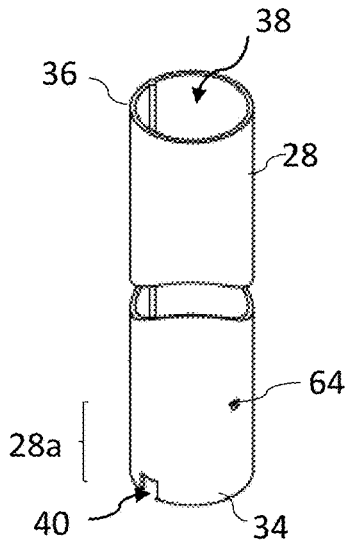
FIG. 11 is a perspective view of an exemplary bollard of the bollard assembly of FIG. 7.

Bollard 28 may include a plate 32 (FIGS. 7, 12), for example stiffener, positioned inside of bollard 28. FIG. 11 illustrates an exemplary bollard 28 having a bottom end 34, a top end 36, and an internal bore 38. A vertical slot 40 extends from bottom end 34. Lock position hole 64 is positioned approximately 90-degrees from slot 40 in this embodiment. The lower end 28*a*, or lower section, of bollard 28 is configured to be disposed inside of the sleeve.

Figure 12:
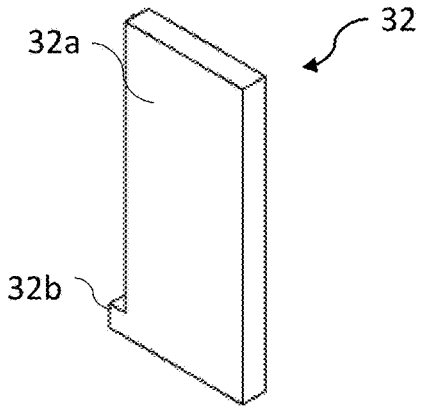
FIG. 12 is a side view of an exemplary bollard stiffener in isolation.

FIG. 12 illustrates a plate 32 of an exemplary embodiment. Plate 32 is a generally L-shaped steel member having a stiffener section 32*a* and an extension section 32*b*. Stiffener section 32*a* is positioned inside of bollard 28, see FIG. 1. Stiffener sections 32*a* has a greater vertical height than extension section 32*b*. Extension section 32*b* extends through slot 40 similar to extension 32*b* shown in FIG. 1. Extension section 32*b* in this embodiment has a shorter vertical height than the extension in the embodiment of FIGS. 1-6. As further described below, extension 32*b* may be a bollard structure that is cooperative with the sleeve structure (FIGS. 13-15) to position bollard 28 in a blocking position (FIG. 7). In the blocking position, the cooperative structures may restrict, e.g., prevent, vertical movement of the bollard relative to the sleeve without rotating the bollard. The blocking position may orient plate generally parallel to the longitudinal axis.

Figure 13:
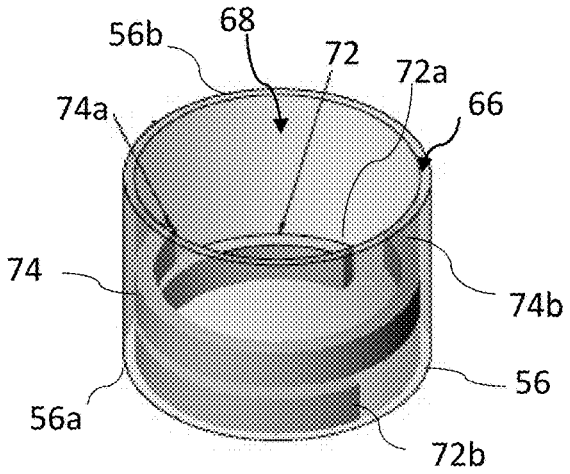
FIG. 13 is a perspective view of an exemplary sleeve revealing an exemplary internal sleeve structure.
Figure 14:
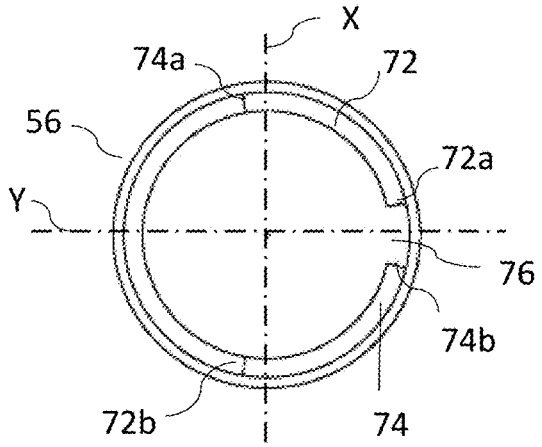
FIG. 14 is a top view of the exemplary sleeve of FIG. 13.
Figure 15:
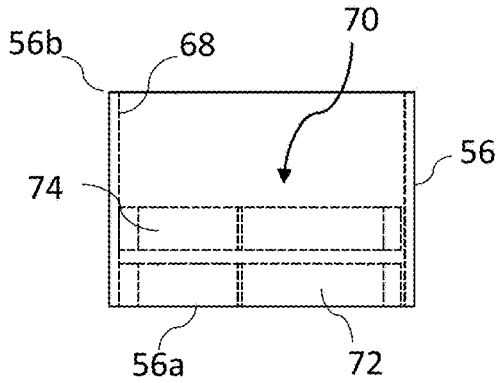
FIG. 15 is a front view of the exemplary sleeve of FIG. 13.

FIGS. 13-15 illustrate an exemplary sleeve 56. Sleeve 56 has a bottom end 56*a*, a top end 56*b*, a top opening 66, and an internal bore 68. Bottom end 56*a* is attached directly to the bottom plate for example by a weld. A collar 78 (FIGS. 7, 8) is attached directly to top end 56*b* and encircles top opening 66. Collar 78 has a greater outer diameter than sleeve 56. Receiver 62 (FIGS. 8, 9) is secured to sleeve 56 at top end 56*b* and is accessible through collar 78. With reference to FIGS. 8 and 9, sleeve 56 extends above side bars 20*a*, 20*b*. In this embodiment, base 44 has a base height 44H of approximately 8 inches. When base 44 is placed in an excavation and covered with concrete, the base height, or foundation height, is approximately 8 inches from bottom plate 12 to proximate collar 78 so that collar 78 is revealed when base 44 is set in concrete.

Sleeve 56 has a structure 70 positioned in internal bore 68 and that is cooperative with a bollard structure, for example extension 32*b*, to position the bollard in a blocking position. In an exemplary embodiment structure 70 includes a bottom semi-circular ring 72 having a first end 72*a* and a second end 72*b* and an upper semi-circular ring 74 having a third end 74*a* and a fourth end 74*b*. Upper semi-circular ring 74 is located above bottom semi-circular ring 72 relative to bottom end 56*a* and the bottom plate with third end 74*a* and fourth end 74*b* radially offset from first end 72*a* and second end 72*b*. A vertical slot 76 between the first and second ends 72*a*, 72*b* and the third and fourth ends 74*a*, 74*b* extends from top opening 66 to bottom end 56*a* and the bottom plate. Vertical slot 76 and receiver 62 (FIG. 8) may be co-axial.

Figure 16:
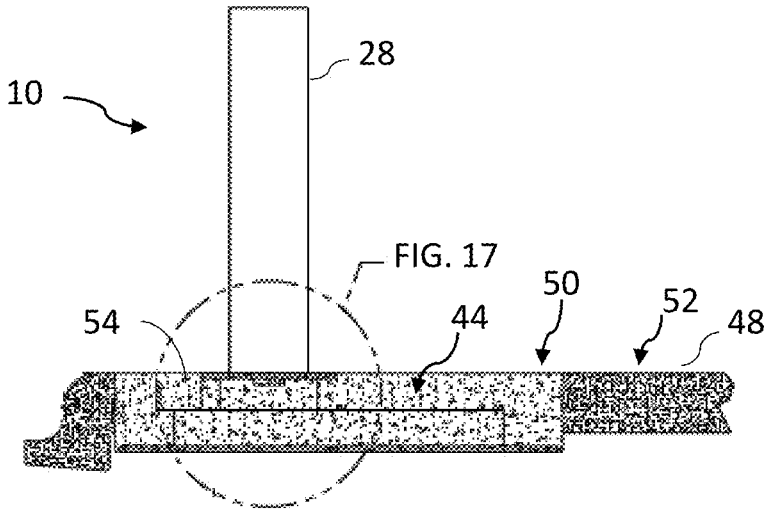
FIG. 16 is a right-side view of the exemplary bollard assembly of FIG. 7 positioned in an excavation and set in concrete.
Figure 17:
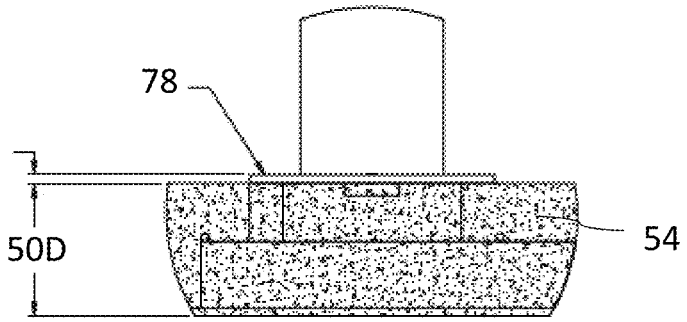
FIG. 17 is an enlarged view of the section identified in FIG. 16.

FIGS. 16-17 illustrate installation of a bollard assembly 10 in a pre-existing concrete slab 48 such as a sidewalk. An excavation 50 having a depth 50D from grade 52 is made in the concrete slab 48. In this example, depth 50D is approximately 8 inches for a bollard assembly having a base height of approximately 8 inches. The base is placed is placed in the excavation with bollard 28 extending above grade and concrete 54 is poured on top of base 44 to fill excavation 50 to grade 52. Collar 78 remains at or above grade to access the latch.

Attachment and removal of bollard 28 is now described with reference to FIGS. 7-15. Bollard 28 is attached to base 44 by inserting lower end 28*a* into internal bore 68 of sleeve 56 through top opening 66 positioning the bottom end of the bollard on bottom plate 12. A bollard structure, for example extension 32*b*, protruding from the lower end of the bollard passes through vertical slot 76 when the bollard is inserted into and removed from sleeve 56. With the bottom end of the bollard on bottom plate 12, the bollard is rotated to move the bollard structure from vertical slot 76 to a blocking position with the bollard structure positioned below upper semi-circular ring 74. In the blocking position, the bollard structure may abut one of the first or second end 72*a*, 72*b* of the lower semi-circular ring. With bollard 28 in the blocking position, latch 60 can be placed in engagement with bollard 28 and sleeve 56 preventing rotation of bollard 28. To remove bollard 28 from base 44, latch 60 is disengaged from the bollard and the sleeve, the bollard is rotated from the blocking position to a position with the bollard structure in vertical slot 76, and the bollard is then lifted out of sleeve 56.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include such features, elements and/or states. As used herein, the terms "connect," "connection," "connected," "in connection with," and "connecting" may be used to mean in direct connection with or in connection with via one or more elements. Similarly, the terms "couple," "coupling," and "coupled" may be used to mean directly coupled or coupled via one or more elements.

The term "substantially," "approximately," and "about" is defined as largely but not necessarily wholly what is specified (and includes what is specified; e.g., substantially 90 degrees includes 90 degrees and substantially parallel includes parallel), as understood by a person of ordinary skill in the art. The extent to which the description may vary will depend on how great a change can be instituted and still have a person of ordinary skill in the art recognized the modified feature as still having the required characteristics and capabilities of the unmodified feature. In general, but subject to the preceding, a numerical value herein that is modified by a word of approximation such as "substantially," "approximately," and "about" may vary from the stated value, for example, by 0.1, 0.5, 1, 2, 3, 4, 5, 10, or 15 percent.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure and that they may make various changes, substitutions, and alterations without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A bollard assembly, comprising:

a bottom plate having a front edge, an aft edge, and a longitudinal axis extending in a front-to-aft direction and a lateral axis orthogonal to the longitudinal axis;

a pair of side bars, having front ends and aft ends, attached to a top plate surface of the bottom plate, and extending generally parallel to the longitudinal axis, the front ends located aft of the front edge and the aft ends located forward of the aft edge;

a front bar equal in height to the pair of side bars and attached directly to the top surface proximate the front ends and extending to and in contact with the pair of side bars, wherein there is not a metal member in contact with the aft ends and the bottom plate whereby an area between the pair of side bars and the front bar is enclosed on three sides and is open between the aft ends; and a bollard connected to the bottom plate aft of the front bar and between the pair of side bars.

2. The bollard assembly of claim 1, comprising a base height of approximately 4-inches to approximately 8-inches including the bottom plate and the pair of side bars.

3. The bollard assembly of claim 1, further comprising a plate positioned inside of the bollard and extending vertically from a bottom end of the bollard.

4. The bollard assembly of claim 3, wherein the plate comprises an extension extending outside of the bollard and attached directly to the front bar.

5. A bollard assembly, comprising:

a bottom plate having a front edge, an aft edge, and a longitudinal axis extending in a front-to-aft direction and a lateral axis orthogonal to the longitudinal axis;

a pair of side bars, having front ends and aft ends, attached to a top plate surface of the bottom plate, and extending generally parallel to the longitudinal axis, wherein an area between the pair of side bars and above the bottom plate is not enclosed by a metal member;

a bollard connected to the bottom plate between the pair of side bars; and a plate positioned inside of the bollard and extending vertically from a bottom end of the bollard.

6. The bollard assembly of claim 5, wherein the front ends and the aft ends are located inward of the front edge and the aft edge; and further comprising a front bar attached directly to the top plate surface proximate the front ends and extending to the pair of side bars.

7. The bollard assembly of claim 6, wherein the plate comprises an extension extending outside of the bollard and attached directly to the front bar.

8. The bollard assembly of claim 6, wherein the pair of side bars and the front bar are planar members extending the same height above the bottom plate.

9. The bollard assembly of claim 8, wherein the bottom plate, front bar, and pair of side bars extend approximately 4.5 inches.

10. The bollard assembly of claim 7, comprising a base height of approximately 4-inches to approximately 8-inches including the bottom plate and the pair of side bars.

11. The bollard assembly of claim 7, wherein the pair of side bars and the front bar are planar members extending the same height above the bottom plate.

12. The bollard assembly of claim 11, wherein the bottom plate, front bar, and pair of side bars extend approximately 4.5 inches.

13. A bollard assembly, comprising:

a bottom plate having a front edge, an aft edge, and a longitudinal axis extending in a front-to-aft direction and a lateral axis orthogonal to the longitudinal axis;

a pair of side bars, having front ends and aft ends, attached to a top plate surface of the bottom plate, and extending generally parallel to the longitudinal axis;

a bollard connected to the bottom plate between the pair of side bars; and a plate positioned inside of the bollard and extending vertically from a bottom end of the bollard.

14. The bollard assembly of claim 13, wherein the plate comprises an extension extending outside of the bollard and parallel to the longitudinal axis.

15. The bollard assembly of claim 13, wherein the front ends are located aft of the front edge and the aft ends are located forward of the aft edge; and further comprising a front bar attached directly to the top plate surface proximate the front ends and extending to the pair of side bars.

16. The bollard assembly of claim 15, comprising a base height of approximately 4-inches to approximately 8-inches including the bottom plate and the pair of side bars.

17. The bollard assembly of claim 15, wherein the plate comprises an extension extending outside of the bollard, parallel to the longitudinal axis, and connected to the front bar.

18. The bollard assembly of claim 17, wherein the pair of side bars and the front bar are planar members extending the same height above the bottom plate.

19. The bollard assembly of claim 18, wherein the bottom plate, front bar, and pair of side bars extend approximately 4.5 inches.

* * * * *